US005080062A

United States Patent [19]

Strenzke

[11] Patent Number: 5,080,062

[45] Date of Patent: Jan. 14, 1992

[54] METHOD AND APPARATUS FOR OPERATING A DRIVE UNIT

[75] Inventor: Hilmar Strenzke, Aschaffenburg, Fed. Rep. of Germany

[73] Assignee: Linde Aktiengesellschaft, Fed. Rep. of Germany

[21] Appl. No.: 693,548

[22] Filed: Apr. 30, 1991

Related U.S. Application Data

[63] Continuation of Ser. No. 498,813, Mar. 23, 1990, abandoned.

[30] Foreign Application Priority Data

Apr. 10, 1989 [DE] Fed. Rep. of Germany ..... 3911706

[51] Int. Cl.[5] ..... F02D 31/00

[52] U.S. Cl. ..... 123/352

[58] Field of Search ..... 123/352, 357, 339, 399; 180/177; 364/431.07, 426.04

[56] References Cited

U.S. PATENT DOCUMENTS

| | | | |
|---|---|---|---|
| 4,780,827 | 10/1988 | Fujimori et al. | 364/431.07 |
| 4,785,777 | 11/1988 | Hock et al. | 123/352 |
| 4,787,352 | 11/1988 | Anderson | 123/352 |
| 4,843,553 | 6/1989 | Ohata | 364/426.04 |
| 4,860,707 | 8/1989 | Ohata | 123/339 |
| 4,877,003 | 10/1989 | Shimpmura et al. | 123/339 |
| 4,898,137 | 2/1990 | Fujita et al. | 180/177 |
| 4,905,785 | 3/1990 | Kieffer et al. | 180/177 |

FOREIGN PATENT DOCUMENTS

| | | | |
|---|---|---|---|
| 3321636 | 12/1988 | Fed. Rep. of Germany | 123/352 |

*Primary Examiner*—Raymond A. Nelli

*Attorney, Agent, or Firm*—Webb, Burden, Ziesenheim & Webb

[57] ABSTRACT

A method for operating a drive unit comprised of an internal combustion engine having a hydraulic aggregate group connected to it. The amount of fuel supplied to the engine in the upper idling speed range is limited by a proportionally acting speed regulator. The power consumption of the hydraulic aggregate group is reduced by a maximum load regulator when the engine is overloaded. Theretofore the hydraulic aggregate group is adjusted toward a lower power consumption after the engine speed drops below an arbitrarily rated RPM which is monitored by the maximum load regulator. In order to facilitate a variable power limitation without the use of a hydraulic power limiter, the working RPM of the maximum load regulation is set at an arbitrary value corresponding to a desired power output between the nominal speed of the engine and the upper idling speed of the engine. In order to reduce the precision imposed on the maintenance of the rated RPM a positive RPM feedback is provided so that the idling control characteristic becomes flatter.

3 Claims, 1 Drawing Sheet

METHOD AND APPARATUS FOR OPERATING A DRIVE UNIT

This is a continuation of copending application Ser. No. 07/498,813, filed on Mar. 23, 1990, now abandoned.

BACKGROUND OF THE INVENTION 1. field of the Invention

The invention is directed to a method of operating a drive unit comprised of an internal combustion engine with a hydraulic aggregate group connected to it. The amount of fuel supplied to the engine in the upper idling speed range is limited by a proportional operating speed control. The power consumption of the hydraulic aggregate group is reduced by a maximum load regulator when the engine is overloaded. After the engine speed decreases below an arbitrary prescribed rated RPM, which is monitored by the maximum load regulator, the hydraulic aggregate group is shifted toward a lower power consumption.

Such methods are known and described, for example, in Federal Republic of Germany Patent No. DE-OS 3 21 636. In order to utilize the maximum power of the engine without overloading it, maximum load regulation is provided to monitor the power consumption of the hydraulic aggregate group connected to the engine by comparing the actual RPM of the engine with the prescribed rated RPM, e.g., the nominal speed, and when the engine is overloaded, i.e., when the ac drops below the arbitrarily prescribed rated RPM, emits a signal on the basis of which the power-consuming hydraulic aggregate group is regulated so that the power consumption does not exceed the power output capacity of the engine. The arbitrarily prescribed RPM, which in most cases is the nominal speed of the internal combustion engine, represents the working RPM of the maximum load regulation of the engine. When the engine is not loaded, its actual RPM rises above the rated RPM up to the upper idling speed. The range between the rated RPM (normally the nominal speed) and the upper idling speed is designated as the idling control characteristic at which the amount of fuel injected in a diesel engine, for example, is reduced by centrifugal regulation to prevent the engine from operating overspeed.

In power machines, such as dredges, it is frequently desirable to limit the power of the overall drive unit to a value below the nominal power for certain applications. There are a number of hydraulic circuits for this purpose known as power limiters. In order to obtain a stepped-variable power limitation, a change-over of the hydraulic-mechanical parameters can generally be undertaken. Such circuits and apparatuses are expensive.

The present invention avoids the above noted shortcoming and offers a method of operating a drive unit comprised of an engine and a hydraulic aggregate group connected to it which facilitates a variable power limitation without a hydraulic power limiter.

SUMMARY OF THE INVENTION

The problem is solved according to the present invention in that the rated RPM of the engine on which the maximum load regulation reacts (i.e., the working RPM of the maximum load regulation) is set at an arbitrary value between the nominal speed of the engine and the upper idling speed, corresponding to a desired power output. A power lower than the nominal power can thus be adjusted through the use of a maximum load regulator for which its working RPM, i.e., the selected rated value, is set at a RPM value inside the idling control characteristic. The maximum load regulator is thus operated within the range of the idling control characteristic of the engine. In a diesel engine with a proportional RPM regulator (governor) the amount of fuel added by the injector is reduced in this range to a fraction of the injection amount, by which the power output of the diesel engine is reduced, in which case the RPM of the diesel engine is increased rather than reduced. This is particularly advantageous because the hydraulic equipment connected to the engine can continue to be operated with an approximately constant nominal speed. On the other hand, this nominal speed would be substantially reduced if power reduction were to be achieved by a RPM reduction below the nominal speed, as is the case with a conventional power limitation.

Operation of a maximum load regulation in the point of rated power so that it is regulated when the speed is suppressed into the range of the idling control characteristic is known from the above German patent. However, it is new to utilize the range of the idling control characteristic for a variable power limitation at a high working speed by adjusting the desired value, i.e., the working RPM of the maximum load regulation to a RPM corresponding to a desired power output. The power that can be put out by the diesel engine can thus be limited by the amount of fuel injected into the engine without using an expensive hydraulic power limiter.

In order to facilitate a compression regulation in this range, it is provided in a further embodiment of the invention to continuously measure the actual RPM of the engine and compare it with the working RPM of the maximum bad regulation, in which case the comparison signal is supplied to an electronic maximum load regulator and the power consumption of the hydraulic aggregate group is regulated proportionally to the comparison signal.

The characteristic conditioned RPM variation between the nominal speed and the upper idling speed is generally 5–10% of the nominal speed. The regulation range of the maximum load regulator should be small relative to this range of the idling control characteristic in order to achieve as precise a power limitation as possible. Due to this precision requirement on the RPM constant of the power limiting maximum load regulator one embodiment of the invention provides that the amount of fuel injected by the injector is modified toward a lower RPM with identical power output of the diesel engine when it drops below the working RPM. The increase in the idling control characteristic is thus modified, namely flattened. The requirements imposed on the RPM accuracy of the maximum load regulator can thus be reduced in which case the desired power limitation is still very precisely maintained.

A RPM regulating circuit is proposed for this purpose in which a RPM sensor is connected to a tachometer that monitors the speed of the diesel engine and is connected to a summation point loaded by the rated RPM. The summation point is connected to a RPM control unit that is connected through a final control element with a speed regulating unit of the injection pump of the diesel engine. In contrast to the normal operation of maximum load regulators, this positive RPM feedback does not act on the adjustment of an adjustable hydraulic pump connected to the diesel engine but is connected by a suitable final control element to the injection pump of the diesel engine, whereby the diesel RPM in the upper idling speed range is decreased for a greater load.

In order to keep the RPM band of the maximum load regulation small an adjustable pump connected to the engine can also be provided with a pressure interruption and the maximum load regulator designed as a regulator with an integral portion.

BRIEF DESCRIPTION OF THE DRAWINGS

The invention is further described hereinafter in connection with the schematic drawing figures wherein.

DESCRIPTION OF THE PREFERRED EMBODIMENT

Figure 1:
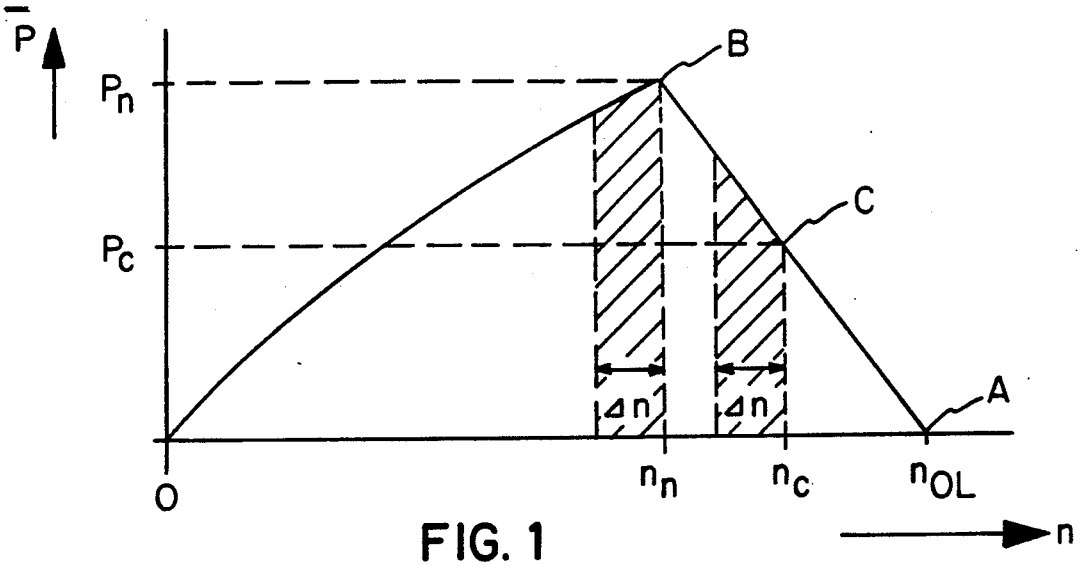
FIG. 1 shows a RPM characteristic curve of a diesel engine.

In FIG. 1 of the drawings the RPM of a diesel engine is plotted on the abscissa and the power out put on the ordinate. A rated RPM, in this example, the nominal speed $n_n$ because full power output is desired (point B), is prescribed. As long as the diesel engine is running without load no power is consumed (point A) and the RPM is above the nominal speed $n_n$ in the so-called upper idling range $n_{OL}$. The range between B and A is designated as the idling control characteristic. In this range the amount of fuel injected is reduced from a maximum value at point B to a minimum value at point A in order to prevent the RPM from rising above $n_{OL}$ and thus destroying the diesel engine. The RPM drops to the nominal speed $n_n$ only when the diesel engine is so heavily loaded that it delivers its maximum power, i.e., if the power consumption of the hydraulic aggregate group reaches the set power output of the diesel engine.

If the diesel engine is loaded even more heavily, its RPM drops below the prescribed nominal speed, so that the maximum load regulation kicks in and reduces the load on the consumer side, e.g., by reducing the delivery volume of an adjustable pump of a hydrostatic drive unit connected to the diesel engine. A stabilization of the speed in the hatched zone $\Delta n$ thus takes place at the nominal speed $n_n$.

If less power than the full power output is desired from the diesel engine, its RPM could be reduced to a value below the nominal speed $n_n$. However, this has the disadvantage that the hydraulic aggregate group connected to the engine can no longer operate with the prescribed nominal speed. It is therefor advantageous to regulate the RPM of the diesel engine to a value above the nominal speed $n_n$ because a higher working speed can be achieved. For this purpose, the desired value of the maximum load regulation, i.e., the working RPM of the maximum load regulation, is adjusted to a RPM value $n_C$ in the range of the idling control characteristic which corresponds to a desired power limitation (point C). Thus, only a fraction of the amount of fuel is injected and therefore a reduced power output of the diesel engine is achieved.

Figure 2:
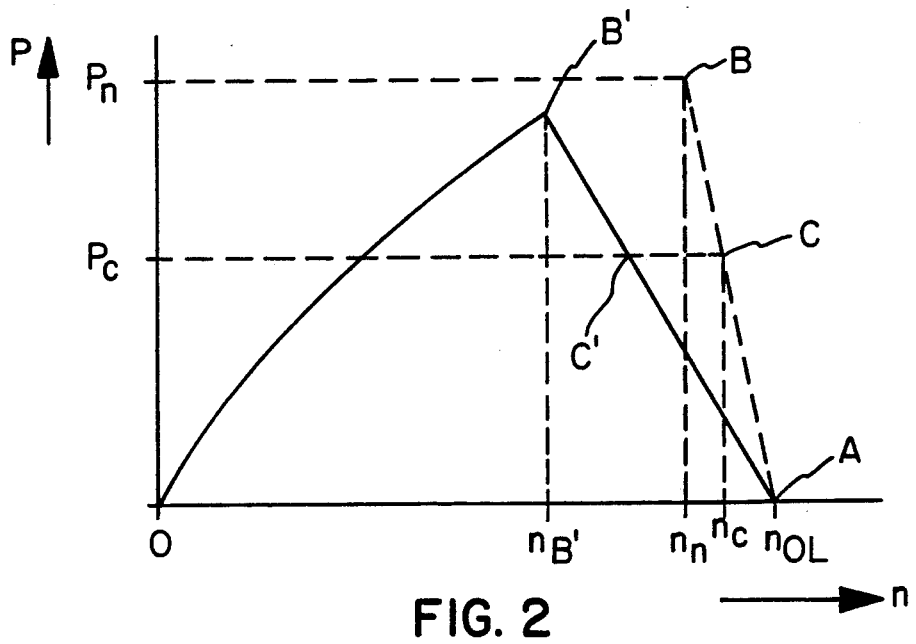
FIG. 2 shows a RPM characteristic curve of a diesel engine with positive RPM feedback.

In order to obtain as precise a maintenance of the desired power output as possible, i.e., as narrow a power limitation as possible, it is important to keep the regulation range $\Delta n$ of the maximum load regulation at point $n_C$ as small as possible. The RPM of the desired power output should thus be maintained as precisely as possible. The idling control characteristic is generally relatively steep which is evident from FIG. 2 of the drawings where a dashed line of the centrifugal regulator of the injection pump is plotted between points B and A. The characteristic line conditioned RPM variation amounts to 5–10% of the nominal speed. It is thus expedient to reduce the slope of the characteristic line in order to be able to reduce the precision requirement imposed on the RPM constancy.

This can be achieved by an additional RPM regulating circuit, namely a positive RPM feedback. The characteristic RPM line modified by such a positive RPM feedback is shown by a solid line. The rise in the idling control characteristic from B' to A is considerably flatter by which the same power (point C') can be set with less precise RPM than on the idling control characteristic B - A (point C), in which case the maximum, power drops somewhat (point B') which is, however, of no significance because only partial power should be adjusted with this method. Point A can also be shifted to other RPM values by other suitable measures, e.g., intervention of the injection pump.

Figure 3:
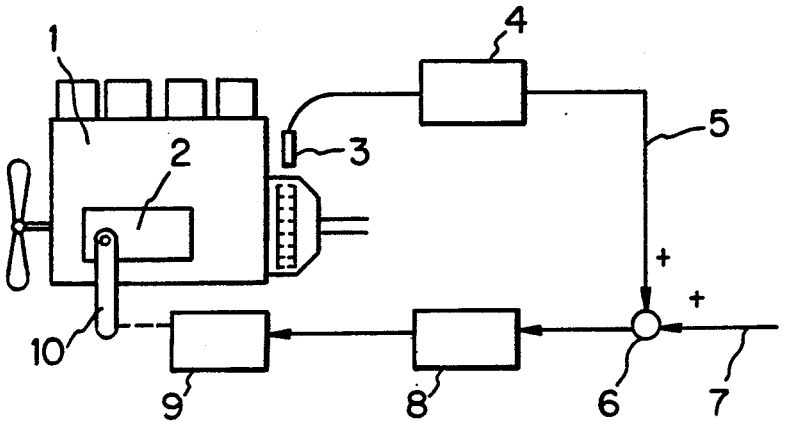
FIG. 3 shows a positive RPM feedback circuit connected to an engine.

FIG. 3 shows a diesel engine having a positive RPM feedback wherein diesel engine 1 is provided with an injection pump 2 and the speed of the diesel engine is sensed by a RPM sensor 3 and transmitted to a tachometer 4. The actual RPM is transmitted through a line 5 to a summation junction 6, which obtains the rated RPM through a line 7 and adds the two RPM values. The summation junction is connected to a speed control unit 8 which is connected to a control element 9. The control element is mechanically connected with a RPM adjusting lever 10 of injection pump 2 to control the fuel injected to the engine.

While a preferred embodiment of the invention is described herein, it is to be understood that the invention may be otherwise embodied within the scope of the appended claims.

I claim:

1. The method of operating an internal combustion engine for a power consuming hydraulic aggregrate group wherein the RPM of said engine is adjustable to a preset RPM between a lower idling speed and a nominal speed and said engine has an upper idling speed range, limiting the supply of fuel to said engine in said upper idling speed range to proportionally regulate the speed of said engine, reducing the power consumption of said power consuming hydraulic aggregate group when said engine is overloaded, decreasing the power consumption of said power consuming hydraulic aggregate group when the speed of said engine drops below said preset RPM, whereby said preset RPM of said engine to which the maximum load regulator reacts is set at a value between said nominal speed of said engine and said upper idling speed of said engine corresponding to a desired power output of said engine.

2. A method according to claim 1, including continuously measuring the operating RPM of said engine and comparing the operating RPM of said engine with the preset RPM of the maximum load to create a comparison signal, transmitting said comparison signal to an electronic maximum load regulator and regulating the power consumption of said power consuming hydraulic aggregate group in proportion to said comparison signal.

3. A method according to claim 2, supplying fuel to said engine driving said power consuming hydraulic aggregate group by an injector, constantly adjusting the rate of supply of fuel to said engine by said injector to a lower rate above said nominal speed of said engine and below said upper idling speed range of said engine, setting a preset RPM corresponding to a desired power output between said nominal speed of said engine and said upper idling speed of said engine by setting the preset RPM of the maximum load regulator in the upper idling speed range, wherein the amount of fuel injected to said engine is modified toward a lower RPM with an identical engine power output when said engine speed drops below said preset RPM.

* * * * *

UNITED STATES PATENT AND TRADEMARK OFFICE

CERTIFICATE OF CORRECTION

PATENT NO. : 5,080,062

DATED : January 14, 1992

INVENTOR(S) : Hilmar Strenzke

It is certified that error appears in the above-identified patent and that said Letters Patent is hereby corrected as shown below:

Column 1 Line 9 "field" should read --Field--.

Column 1 Lines 23-24 "3 21 636" should read --33 21 636--.

Column 1 Line 30 "ac" should read --actual RPM--.

Column 2 Line 35 "bad" should read --load--.

Signed and Sealed this

Fourth Day of May, 1993

*Attest:*

Michael K. Kirk

MICHAEL K. KIRK

*Attesting Officer*

*Acting Commissioner of Patents and Trademarks*